US005829167A

United States Patent [19]

Valenzuela

[11] Patent Number: 5,829,167

[45] Date of Patent: Nov. 3, 1998

[54] ODOR ABSORBING PADS FOR SHOES

[76] Inventor: Jamie Valenzuela, 705 E. Garfield Ave. Apt #4, Glendale, Calif. 91205

[21] Appl. No.: 939,340

[22] Filed: Sep. 29, 1997

[51] Int. Cl.[6] ..... A43B 7/08

[52] U.S. Cl. ..... 36/3 B; 36/11; 36/25 R

[58] Field of Search ..... 36/43, 3 B, 25 R, 36/141, 71

[56] References Cited

U.S. PATENT DOCUMENTS

| | | |
|---|---|---|
| 1,480,234 | 1/1924 | Wedd . |
| 2,200,849 | 5/1940 | Margolin . |
| 2,502,774 | 4/1950 | Alianiello . |
| 4,283,011 | 8/1981 | Spector . |
| 4,507,880 | 4/1985 | Ohashi . |
| 4,557,060 | 12/1985 | Kawashima . |
| 4,760,655 | 8/1988 | Mauch . |
| 4,841,648 | 6/1989 | Shaffer . |
| 5,732,485 | 3/1998 | Laughlin et al. . |

*Primary Examiner*—Ted Kavanaugh

[57] ABSTRACT

Odor absorbing pads for shoes are provided including a shoe having a sole with a top surface and a lower surface. The shoe further includes an upper portion coupled to the sole for encompassing a foot of a user. At least one unitary flexible housing has a top face and a bottom face with a periphery formed therebetween defining an interior space. The top face has a plurality of breathing apertures formed therein. The bottom face of each flexible housing has a layer of adhesive formed thereon. Each flexible housing has a generally disk-shaped configuration. A predetermined amount of charcoal particulates are situated within the interior space of the housing for absorbing odor from the foot of the user. Further, a predetermined amount of medicated powder is situated within the interior space of the housing for preventing the growth of odor producing organisms within the shoe.

4 Claims, 2 Drawing Sheets

ODOR ABSORBING PADS FOR SHOES

BACKGROUND OF THE INVENTION

1. Field of the Invention

The present invention relates to odor absorbing pads for shoes and more particularly pertains to removing odor from shoes.

2. Description of the Prior Art

The use of shoe liners is known in the prior art. More specifically, shoe liners heretofore devised and utilized for the purpose of providing comfort to a user and removing odor are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,399,404; U.S. Pat. No. 4,864,740; U.S. Pat. No. 4,257,176; U.S. Pat. No. 4,185,402; and U.S. Pat. No. 5,261,169.

In this respect, the odor absorbing pads for shoes according to the present invention substantially departs from the conventional concepts and designs of the prior art, and in so doing provides an apparatus primarily developed for the purpose of removing odor from shoes.

Therefore, it can be appreciated that there exists a continuing need for a new and improved odor absorbing pads for shoes which can be used for removing odor from shoes. In this regard, the present invention substantially fulfills this need.

SUMMARY OF THE INVENTION

In view of the foregoing disadvantages inherent in the known types of shoe liners now present in the prior art, the present invention provides an improved odor absorbing pads for shoes. As such, the general purpose of the present invention, which will be described subsequently in greater detail, is to provide a new and improved odor absorbing pads for shoes which has all the advantages of the prior art and none of the disadvantages.

To attain this, the present invention essentially comprises a shoe having a sole with a top surface and a lower surface. The shoe further includes an upper portion coupled to the sole for encompassing a foot of a user. Next provided is a pair of unitary flexible housings each having a generally disk-shaped configuration. Each housing is equipped with an elliptical top face and an elliptical bottom face with a periphery formed therebetween defining an interior space. The top face has a plurality of breathing apertures formed in an entire surface area thereof. The bottom face of each flexible housing has a layer of adhesive formed thereon. As shown in FIGS. 1 & 2, the flexible housings include a first housing adhered to the top surface of the sole of the shoe about two inches from a rear end thereof. A second housing is adhered to the top surface of the sole of the shoe about two inches from a front end thereof. The first housings has a pair of foci in linear alignment with those of the second housing. Preferably, the foci of the housings are further in linear alignment with a center longitudinal line of the sole of the shoe. A predetermined amount of charcoal particulates are situated within the interior space of the housing. In use, the charcoal serves for absorbing odor from the foot of the user. Associated therewith is a predetermined amount of fungicide medicated powder situated within the interior space of the housing for preventing the growth of odor producing organisms within the shoe.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved odor absorbing pads for shoes which has all the advantages of the prior art shoe liners and none of the disadvantages.

It is another object of the present invention to provide a new and improved odor absorbing pads for shoes which may be easily and efficiently manufactured and marketed.

It is a further object of the present invention to provide a new and improved odor absorbing pads for shoes which is of a durable and reliable construction.

An even further object of the present invention is to provide a new and improved odor absorbing pads for shoes which is susceptible of a low cost of manufacture with regard to both materials and labor, and which accordingly is then susceptible of low prices of sale to the consuming public, thereby making such odor absorbing pads for shoes economically available to the buying public.

Still yet another object of the present invention is to provide a new and improved odor absorbing pads for shoes which provides in the apparatuses and methods of the prior art some of the advantages thereof, while simultaneously overcoming some of the disadvantages normally associated therewith.

Still another object of the present invention is to remove odor from shoes.

Lastly, it is an object of the present invention to provide new and improved odor absorbing pads for shoes are provided including a shoe having a sole with a top surface and a lower surface. The shoe further includes an upper portion coupled to the sole for encompassing a foot of a user. At least one unitary flexible housing has a top face and a bottom face with a periphery formed therebetween defining an interior space. The top face has a plurality of breathing apertures formed therein. The bottom face of each flexible housing has a layer of adhesive formed thereon. Each flexible housing has a generally disk-shaped configuration. A predetermined amount of charcoal particulates are situated within the interior space of the housing for absorbing odor from the foot of the user. Further, a predetermined amount of medicated powder is situated within the interior space of the housing for preventing the growth of odor producing organisms within the shoe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
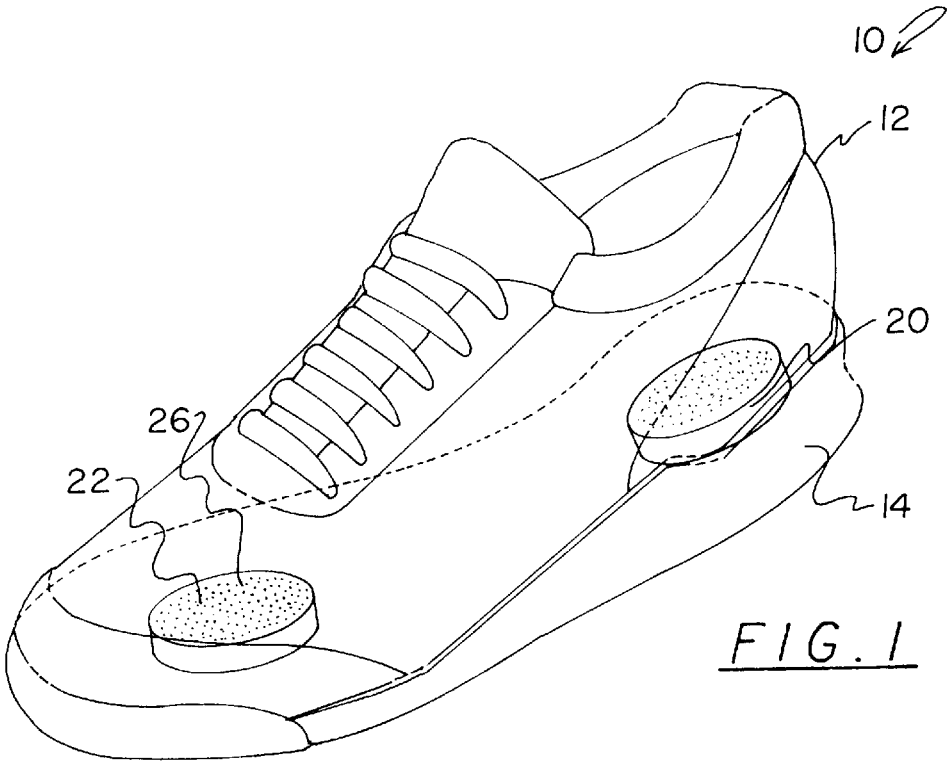
FIG. 1 is a perspective illustration of the preferred embodiment of the odor absorbing pads for shoes constructed in accordance with the principles of the present invention.

With reference now to the drawings, and in particular to FIG. 1 thereof, a new and improved odor absorbing pads for shoes embodying the principles and concepts of the present invention and generally designated by the reference numeral 10 will be described.

The present invention, the new and improved odor absorbing pads for shoes, is comprised of a plurality of components. Such components in their broadest context include a pair of flexible housings. Such components are individually configured and correlated with respect to each other so as to attain the desired objective.

More specifically, it will be noted that the system 10 of the present invention includes a shoe 12 having a sole 14 with a top surface 16 and a lower surface 18. The shoe further includes an upper portion coupled to the sole for encompassing a foot of a user.

Next provided is a pair of unitary flexible housings 20 each having a generally disk-shaped configuration. Ideally, the housing is constructed from an elastomeric material. Each housing is equipped with an elliptical top face 22 and an elliptical bottom face 24 with a periphery formed therebetween defining an interior space. The top face has a plurality of breathing apertures 26 formed in an entire surface area thereof. The bottom face of each flexible housing has a layer of adhesive 28 formed thereon.

Figure 2:
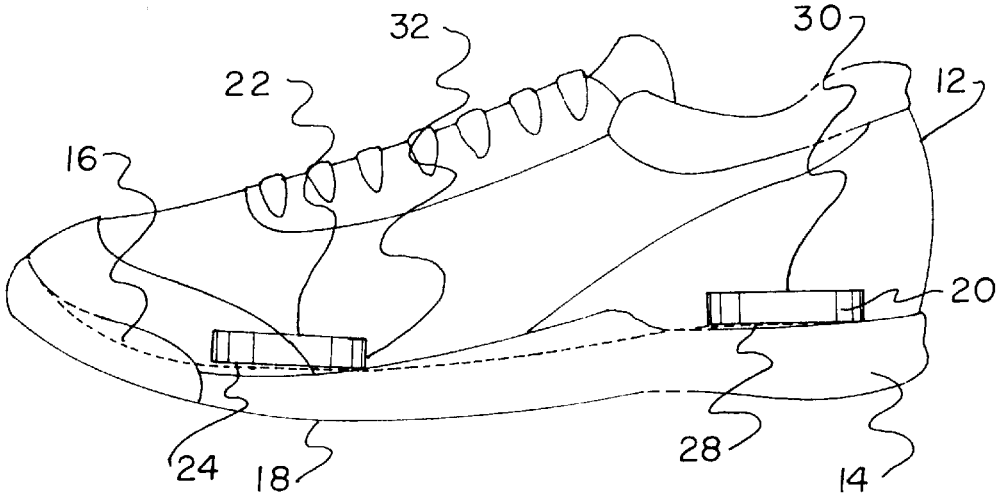
FIG. 2 is a side view of the present invention.
Figure 3:
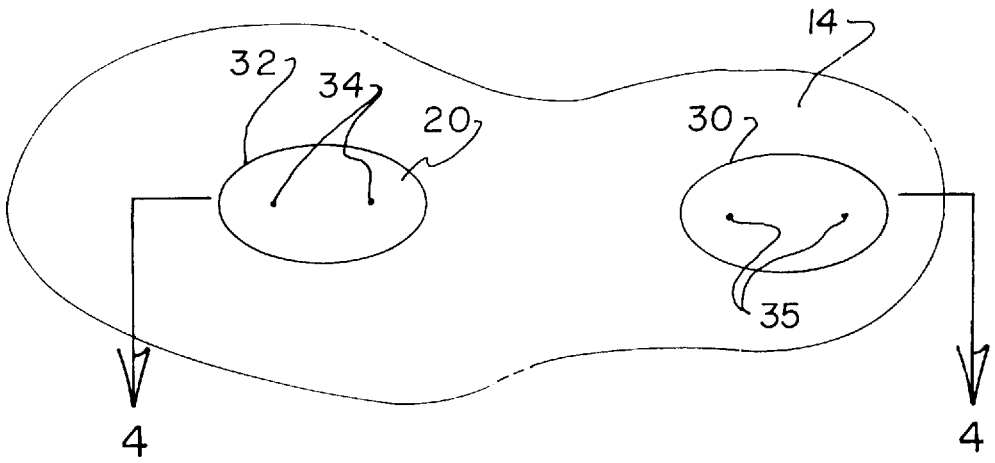
FIG. 3 is a top view of the present invention.
Figure 4:
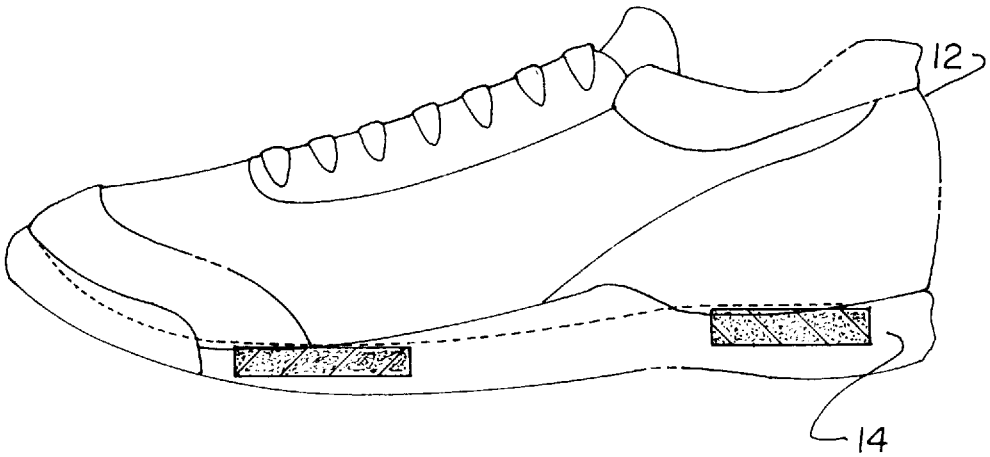
FIG. 4 is a side view of an alternate embodiment of the present invention.

As shown in FIGS. 1 & 2, the flexible housings include a first housing 30 adhered to the top surface of the sole of the shoe about two inches from a rear end thereof. A second housing 32 is adhered to the top surface of the sole of the shoe about two inches from a front end thereof. The first housings has a pair of foci 34 in linear alignment with a pair of foci 35 of the second housing. Preferably, the foci of the housings are further in linear alignment with a center longitudinal line of the sole of the shoe. Note FIG. 3. By this orientation, the housings reside at locations where most of the pressure of the foot of the user is applied. Further, for reasons that will become apparent hereinafter, additional space is afforded beneath the toes and arch of the foot.

A predetermined amount of charcoal particulates 36 are situated within the interior space of the housing. In use, the charcoal serves for absorbing odor from the foot of the user. In the preferred embodiment, the particulates are spherical with a diameter of less than 1/32 of an inch so as not to afford any discomfort to the user. Associated therewith is a predetermined amount of fungicide medicated powder 38 situated within the interior space of the housing for preventing the growth of odor producing organisms within the shoe. As an option, a fragrance powder may be mixed with the medicated powder for further combating odor within the shoe.

While not shown, the powder is ideally situated beneath the charcoal particulates with an optional flexible porous cloth formed therebetween. By this structure, the charcoal is in an optimal position to absorb order and the powder may be dispensed through the charcoal and breathing apertures at a controlled and hindered rate upon the depression of the housing.

In an alternate embodiment, the housings are situated within the sole with the top faces thereof flush with the top surface of the shoe. As such, the housings may be replaced with the sole are simply removed and replaced.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. Odor absorbing pads for shoes comprising, in combination:

a shoe having a sole with a top surface and a lower surface, the shoe further including an upper portion coupled to the sole for encompassing a foot of a user;

a pair of unitary flexible housing each having a top face and a bottom face with a periphery formed therebetween defining an interior space, the housing having a plurality of breathing apertures formed therein, the bottom face of each flexible housing having a layer of adhesive formed thereon wherein the flexible housings are provided with the flexible housings including a first housing adhered to the top surface of the sole of the shoe about two inches from a rear end thereof and a second housing adhered to the top surface of the sole of the shoe about two inches from a front end thereof;

said flexible housings having a generally disk-shaped configuration;

a predetermined amount of charcoal particulates situated within the interior space of the housing for absorbing odor from the foot of the user; and a predetermined amount of medicated powder situated within the interior space of the housing for preventing the growth of odor producing organisms within the shoe.

2. Odor absorbing pads for shoes as set forth in claim 1 wherein the bottom face of each flexible housing has a layer of adhesive formed thereon for removably coupling with the top surface of the sole of the shoe.

3. Odor absorbing pads for shoes as set forth in claim 1 wherein a pair of housings are provided each having an elliptical top face and bottom face, the first housings having a pair of foci in linear alignment with those of the second housing, wherein the foci of the housings are in linear alignment with a center longitudinal line of the sole of the shoe.

4. A new and improved odor absorbing pads for shoes comprising, in combination:

a shoe having a sole with a top surface and a lower surface, the shoe further including an upper portion coupled to the sole for encompassing a foot of a user;

a pair of unitary flexible housings each having a generally disk-shaped configuration with an elliptical top face and an elliptical bottom face with a periphery formed therebetween defining an interior space, the top face having a plurality of breathing apertures formed therein, the bottom face of each flexible housing having a layer of adhesive formed thereon;

said flexible housings including a first housing adhered to the top surface of the sole of the shoe about two inches from a rear end thereof and a second housing adhered to the top surface of the sole of the shoe about two inches from a front end thereof, the first housings having a pair of foci in linear alignment with those of the second housing, wherein the foci of the housings are in linear alignment with a center longitudinal line of the sole of the shoe;

a predetermined amount of charcoal particulates situated within the interior space of the housing for absorbing odor from the foot of the user; and a predetermined amount of fungicide medicated powder situated within the interior space of the housing for preventing the growth of odor producing organisms within the shoe.

* * * * *